US006810987B1

(12) United States Patent
DeKalb

(10) Patent No.: US 6,810,987 B1
(45) Date of Patent: Nov. 2, 2004

(54) EARBUD HEADSET

(75) Inventor: Frederick P. DeKalb, Ben Lomond, CA (US)

(73) Assignee: Plantronics, Inc., Santa Cruz, CA (US)

( * ) Notice: Subject to any disclaimer, the term of this patent is extended or adjusted under 35 U.S.C. 154(b) by 31 days.

(21) Appl. No.: 10/313,156

(22) Filed: Dec. 6, 2002

(51) Int. Cl.[7] ..... H04R 25/00; H04R 25/02

(52) U.S. Cl. ..... 181/129; 181/130; 181/135; 381/328; 381/380; 381/187; D14/223; D14/205

(58) Field of Search ..... 181/129, 130, 181/135; 381/322, 328, 329, 380, 305, 68.6, 69, 138, 187, 188; D24/106, 174; D14/223, 205, 206

(56) References Cited

U.S. PATENT DOCUMENTS 1,668,910 A * 5/1928 Jones ..... 181/130
1,893,143 A * 1/1933 Koch ..... 181/135
1,953,437 A * 4/1934 Schier ..... 181/135
3,041,856 A * 7/1962 Neal ..... 181/129
4,420,657 A * 12/1983 Larkin ..... 181/129
4,736,435 A * 4/1988 Yokoyama et al. ..... 381/380
5,712,453 A 1/1998 Bungardt et al.
5,953,435 A 9/1999 Mullin et al.
6,411,722 B1 * 6/2002 Wolf ..... 381/380
2003/0196850 A1 * 10/2003 Dyer et al. ..... 181/135

* cited by examiner

*Primary Examiner*—Shih-Yung Hsieh
*Assistant Examiner*—Edgardo San Martin
(74) *Attorney, Agent, or Firm*—Peter Hsieh

(57) ABSTRACT

An earbud headset is provided that includes a speaker housing which advantageously allows for improved comfort, sound quality, and stability in the ear. The speaker housing includes a head portion and a thin edge portion that extends from the head portion to interface with a faceplate. The thin edge portion allows for acoustic coupling to deeper areas of the user's ear to provide better sound quality. A bias member is operably coupled to the speaker housing to contact an upper concha of the user's ear to provide bias forces for improved stability, sound quality, and universal fit.

27 Claims, 5 Drawing Sheets

EARBUD HEADSET

BACKGROUND OF THE INVENTION

1. Field of Invention

This invention generally relates to headsets containing earphones and, more particularly, to an "in-the-ear" type headset apparatus with improved wearing stability, universal fit, and sound quality.

2. Discussion of the Related Art

Headsets are gaining in popularity in and out of the workplace as more and more users either have jobs requiring that they spend a substantial amount of time on the telephone or users simply desire to listen to audio or speak on the telephone with their hands free to perform other tasks.

One type of headset, which can incorporate one or two earphones for monaural or stereo listening, is known as an "in-the-ear" type headset or "earbud" headset, which employs earphones that can be disposed in the lower concha area of the ear. Such devices can be used for delivering radio, stereo, two-way, and/or telephonic-type communications to a user.

Hands-free headsets which are placed in the ear must adapt to a wide variety of ear shapes and sizes in order to fit a large percentage of users. Comfort, stability, and high sound quality are key elements that must be met in order for a headset to be acceptable to the end user. However, different ear shapes and sizes make it difficult for a single design to both fit the ear correctly and stabilize the headset. Lack of good coupling to the ear results in unclear transmission of sound from the transducer and inability to block out external noise. Headsets including a microphone coupled by a boom cause additional complexity as these headsets need to support the weight and movement of the boom with just the fit of the earphone in the ear.

A conventional method and apparatus for making an in-the-ear headset fit a wide variety of ear sizes has been to offer various accessories that slip over the earphone to provide a larger profile to fill a lower concha area of the user's ear.

Such previous methods and apparatus have several disadvantages. It has been typically required that the output face of the earphone be maintained in the ear of the user with high force to maintain positional stability. Consequently, a major disadvantage of these previous methods and apparatus has been discomfort from the high contact forces against the ear. Another disadvantage has been the lack of positional stability in the ear after a period of time in which the earphone may become dislodged by the aggregate of movements by the user. Furthermore, most typical speaker caps are too thick and do not allow the speaker to be placed down into the ear adequately for a stable and secure fit. The addition of rubber rings, cushions, or other accessories around the earphone can act to further push the speaker out of the ear and away from the ear canal, resulting in decreased coupling and sound quality. As the ear canal is located in the forward part of the ear, the addition of accessories can actually act to block the sound and further impede the user's ability to hear.

Therefore, there is a need in the art for a headset apparatus that is comfortable, stable on the ear, universally fitting, and provides high sound quality.

SUMMARY

The present invention provides an earbud headset that allows for improved comfort, sound quality, and stability on the ear without the need for a headband, ear hook, or other accessories, such as a ring or cushion. Advantageously, a thin edge portion in conjunction with a bias member allows for greater acoustic coupling in front of the ear canal, and since no accessories such as rings or cushions are required, sound may be more clearly transmitted to the ear canal, resulting in improved sound quality.

According to one embodiment of the present invention, an earbud headset is provided, including a speaker housing. The speaker housing includes a head portion for contacting a lower concha of a ear, and a thin edge portion that extends from the head portion to interface with a faceplate. A bias member is operably coupled to the speaker housing and is capable of contacting a portion of the upper concha of the ear.

According to another embodiment of the present invention, an earbud headset is provided, including a speaker housing that has a center portion with a concave surface. A head portion, which extends from the center portion for contacting a lower concha of a ear, includes a transducer.

According to another embodiment of the present invention, an earbud headset is provided, including a speaker housing that has a tail portion for contacting an intertragic notch of the ear. A center portion, which extends from the tail portion, is capable of contacting a portion of a tragus and an anti-tragus of an ear.

Advantageously, the present invention allows for universal fit in ears of various sizes while providing enhanced sound quality and positional stability.

These and other features and advantages of the present invention will be more readily apparent from the detailed description of the embodiments set forth below taken in conjunction with the accompanying drawings.

BRIEF DESCRIPTION OF DRAWINGS

Use of the same reference symbols in different figures indicates similar or identical items. It is further noted that the drawings may not be drawn to scale.

DETAILED DESCRIPTION

Figure 1:
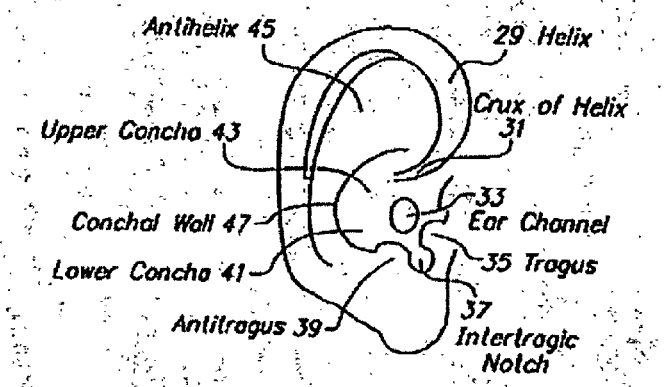
FIG. 1 illustrates relevant parts of a typical human ear.

For illustration purposes and to aid in the understanding of the placement of the present invention, a typical human ear is illustrated in FIG. 1. The outer ear, or pinna, is an irregularly concave cartilaginous member including a number of eminences and depressions which give each ear a distinct shape and form. The helix 29 is the curved outer rim of the ear. Below the helix 29 is the antihelix 45. The antihelix 45 is a curved prominence which describes a curve around the concha, a deep cavity containing the entry to the ear canal 33. The concha is divided into two parts, the upper concha 43 and the lower concha 41, by the crux of the helix 31 which curves around the outside of the ear, and extends inwards at about the vertical midpoint of the ear. The upper concha 43 lies above the crux of the helix 31 and below the antihelix 45. The lower concha 41 lies below the crux of the helix 31 and surrounds the entry to the ear canal 33. The conchal wall 47 separates the concha from the antihelix 45. In front of the lower concha 41 and projecting backwards from the front of the ear is the tragus 35, a small semicircular prominence. Opposite the tragus 35 and separated from it by the deep curvature of the intertragic notch 37 is the antitragus 39. The intertragic notch 37 is formed between the tragus 35 and the antitragus 39.

Figure 2:
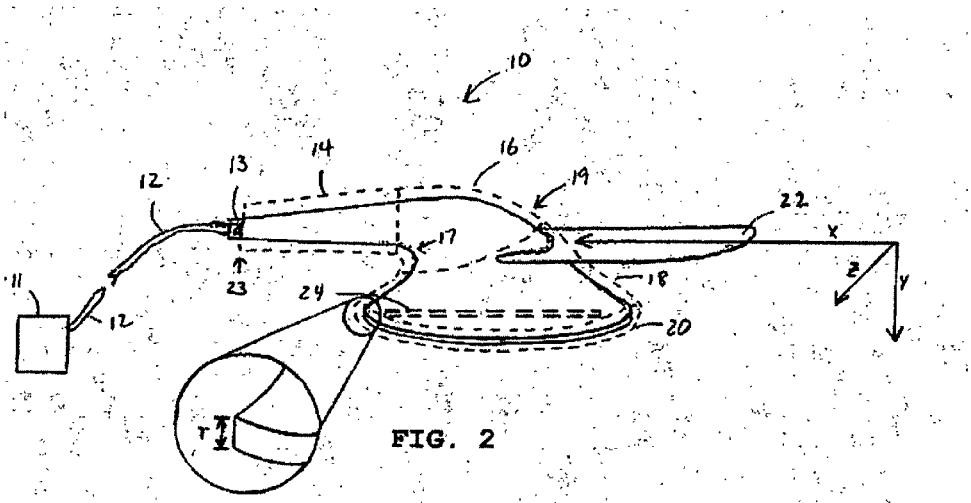
FIG. 2 illustrates a side view of an earbud headset in accordance with an embodiment of the present invention.
Figure 3:
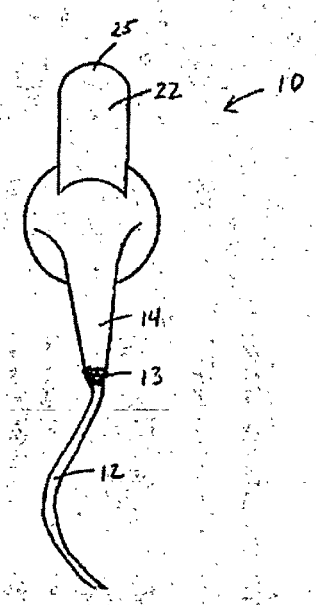
FIGS. 3 and 4 illustrate a back view and a front view, respectively, of an earbud headset in accordance with an embodiment of the present invention.
Figure 4:
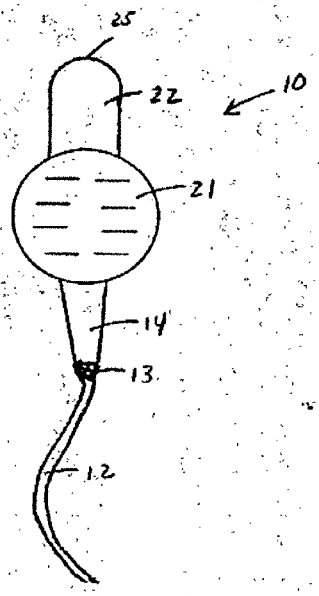

FIGS. 2, 3, and 4 illustrate a side view, a back view, and a front view, respectively, of an enhanced earbud headset 10 in accordance with an embodiment of the present invention. As shown in FIG. 2, earbud headset 10 can be used with an audio source 11, such as a telephone handset, a cellular phone, a personal computer, a media player, or a communication network. However, the invention is not limited to receiving a signal from a specific audio source. Earbud headset 10 may also be used for either monaural or stereo listening by applying an earbud headset 10 to one or each ear of a user.

FIG. 2 shows, in one embodiment, earbud headset 10, which includes a speaker housing 19. Speaker housing 19 includes a tail portion 14, a center portion 16, a head portion 18, and a thin edge portion 20 that interfaces with a faceplate 21 (FIG. 4), each portion of speaker housing 19 being designated by dashed-lines.

In one example, speaker housing 19 encases a speaker or an audio transducer 24, in particular within head portion 18, in one example. Wires leading from audio source 11 to transducer 24 are also partially housed within speaker housing 19.

Speaker housing 19 may be formed as an integrated single structure. Portions 14, 16, 18, and 20 are denoted by the dashed-line enclosures for descriptive purposes and accordingly, the interfaces of the different portions may be adjusted as necessary in different embodiments. It should also be understood that not all sections or portions described above are required at once to allow the present invention to function.

In one embodiment, tail portion 14 is shaped to taper from an interface with center portion 16 toward a first end 23. Tail portion 14 is substantially tubular and hollow for receiving a cable 12, which encloses the wires leading from audio source 11 to transducer 24. Cable 12 is operably coupled to transducer 24 to carry signals, which can be converted to an audio signal by transducer 24. Cable 12 is used to protect the wires and may be made from a non-conductive material, as is known in the art. It is noted that cable 12 may be received by other portions of speaker housing 19 in other embodiments of the present invention.

Optionally, a cable boot 13 can be operably coupled to first end 23 of tail portion 14. In this embodiment, cable boot 13 surrounds a portion of cable 12 immediately adjacent to first end 23 of tail portion 14 to protect cable 12 from strain typically experienced in this portion of cable 12 due to the bending and pulling of cable 12 that may cause a malfunction. It is noted that cable boot 13 may be coupled to other portions of speaker housing 19 in other embodiments of the present invention.

As illustrated in FIG. 2, center portion 16 extends from tail portion 14 and forms a substantially curved conical section increasing in diameter from tail portion 14 toward head portion 18. Center portion 16 includes a substantially concave surface 17, which provides for an ergonomic form to allow headset 10 to securely and comfortably mount on the user's ear. For example, concave surface 17 allows tail portion 14 and center portion 16 to contact the tragus and anti-tragus and/or the intertragic notch of the user's ear with improved stability and comfort.

Head portion 18 extends from center portion 16 and houses transducer 24 (outline shown by long dashed lines). Transducer 24 can be any type of electromagnetic, piezoelectric, or electrostatic type of driving element, or a combination thereof, or another form of driving element, for generating sound waves from the output face of the transducer.

In one embodiment, transducer 24 receives electric signals from audio signal source 11 via wires in cable 12. The signals may be digital or analog in nature. Transducer 24 converts the electric signal to an audio signal and directs the audio signal toward faceplate 21 (FIG. 4). In another embodiment, transducer 24 may receive signals through wireless communication channels, such as by Bluetooth™ protocols and hardware, in one example.

Head portion 18 is substantially conical with an increasing diameter extending from center portion 16 toward thin edge portion 20. However, head portion 18 is sized to be as small as the enclosed transducer will allow to maximize fit into the recess of the user's ear. In one example, with no intent to limit the invention thereby, the diameter of transducer 24 is between about 12 mm and about 14 mm, preferably about 13.6 mm.

Thin edge portion 20 extends from head portion 18 and is shaped to have a substantially constant diameter in one embodiment. In another embodiment, thin edge portion 20 may also have the substantially same diameter as head portion 18 where the two portions 18 and 20 meet. In one embodiment, thin edge portion 20 may be molded as a single structure with head portion 18. In other embodiments, thin edge portion 20 may include a separate cap that is operably coupled to head portion 18. Thin edge portion 20 is sized to be as thin as possible to interface with faceplate 21 and accommodate the transmission of sound from transducer 24. In one example, thin edge portion 20 is formed to have a thickness T (FIG. 2 inset) of less than about 1 mm.

Thin edge portion 20 interfaces with faceplate 21 (FIG. 4), which is used to direct sound from transducer 24 toward the user's eardrum, regardless of whether earbud headset 10 is in the right ear or the left ear. It should be understood that the invention is not limited to a specific faceplate and any appropriate faceplate that fits within thin edge portion 20 (and in some cases head portion 18) may be used to direct sound from the transducer to the user's eardrum.

Advantageously, thin edge portion 20 allows for enhanced acoustic coupling to deeper areas of the user's ear, in particular the entrance area to the ear canal, to block out external noise while directing sound from the transducer to the eardrum. Excluding external sounds from the ear and providing increased coupling to the entrance to the ear canal enhances the performance of earbud headset 10 in a noisy environment.

As further illustrated in FIGS. 2, 3, 4, and 5, a bias member 22 is operably attached to speaker housing 19. It is noted that bias member 22 is coupled to speaker housing 19 along a portion substantially behind and apart from the plane of the surface of faceplate 21. In one embodiment, bias member 22 is operably coupled to speaker housing 19 along head portion 18 or along center portion 16. In another embodiment, bias member 22 is operably coupled to speaker housing 19 substantially opposite concave surface 17.

Bias member 22 allows for a contact area "C" (FIG. 5) between top portion 25 (FIGS. 3 and 4) of bias member 22 and a portion of the user's upper concha, below the antihelix, when the earbud headset is worn. Accordingly, top portion 25 of bias member 22 is substantially set apart from and/or behind a plane of faceplate 21 interfaced with thin edge portion 20 and will make contact with the user's upper concha apart from that plane. Contact area "C", in conjunction with the positioning of bias member 22 along speaker housing 19, provides sufficient pressure and friction to increase headset stability and acoustic coupling between thin edge portion 20 and the user's ear when head portion 18 and transducer 24 are placed deeper into a user's ear because of the advantageously formed thin edge portion 20.

Advantageously, the positioning of bias member 22 along head portion 18 or center portion 16 allows for a biasing force Z with components along the x and y axes (FIG. 2), against the headset where bias member 22 is coupled to speaker housing 19. Axis x and axis y are parallel and perpendicular, respectively, to a surface of faceplate 21 interfaced with thin edge portion 20. Accordingly, biasing force Z is directed toward thin edge portion 20 and faceplate 21 in a direction between the x and y axes. In one embodiment, biasing forces are provided against speaker housing 19 behind transducer 24 and toward faceplate 21 with components parallel and perpendicular (i.e., along y and x axes) to faceplate 21. Therefore, bias member 22, in accordance with the present invention, allows for biasing forces substantially apart from and/or behind the plane of faceplate 21 interfaced with thin edge portion 20. Advantageously, such biasing forces along the x and y axes toward thin edge portion 20 and faceplate 21 provide for enhanced headset stability and acoustic coupling to the ear.

In one embodiment, bias member 22 is movably connected to head portion 18 by a movable joint, such as a hinge mechanism. In another embodiment, bias member 22 and head portion 18 are coupled as a single structure, thereby not allowing for any movement between bias member 22 and the speaker housing. It should be understood that bias member 22 may be coupled to head portion 18 by conventional means known in the art, such as by an adhesive or by molding as a single structure with the speaker housing.

Bias member 22 is elongated and flexible in one embodiment, permitting a spring hinge-like action which automatically adjusts bias member 22 to the size and shape of the upper concha, while providing sufficient force to hold speaker housing 19, in particular head portion 18 and thin edge portion 20, against the lower concha. In one embodiment, bias member 22 is made of material that is sufficiently rigid to provide both flexibility for, and resistance to, positional deformation, and which allows for comfortable and safe biasing against the user's ear. For example, bias member 22 can be made from a non-abrasive and flexible material, such as a soft elastomer, foam, plastic material, and the like.

Bias member 22 is also formed into a shape for comfortable and safe biasing against the user's ear, and in particular, the upper concha. In one embodiment, bias member 22 is shaped to curve away from thin edge portion 20 and toward center portion 16 to enhance contact with the upper concha of the user's ear and to provide greater bias force. Bias member 22 may further have a uniform width or can taper from head portion 18 toward the tip that will contact the upper concha. Bias member 22 can also taper in the reverse direction from the tip that will contact the upper concha toward head portion 18. However, the present invention is not limited to the aforementioned shapes for bias member 22 and any shape or shapes may be used which allow for comfortable, safe, and stabilizing contact with the user's upper concha.

It is noted that bias member 22 may need to be flexed in order to maintain the contact point against the surface of the upper concha. The degree of angular flexure is dependent upon the size and shape of the user's ear, particularly the upper concha, the antihelix, and the crux of the helix. The general flexibility and resilience of bias member 22 in combination with the overall shape of the speaker housing advantageously allow bias member 22 to automatically adjust to the size and shape of the user's upper concha 43 without any additional mechanical devices so as to be universally-fitting while providing stability and comfort.

Figure 5:
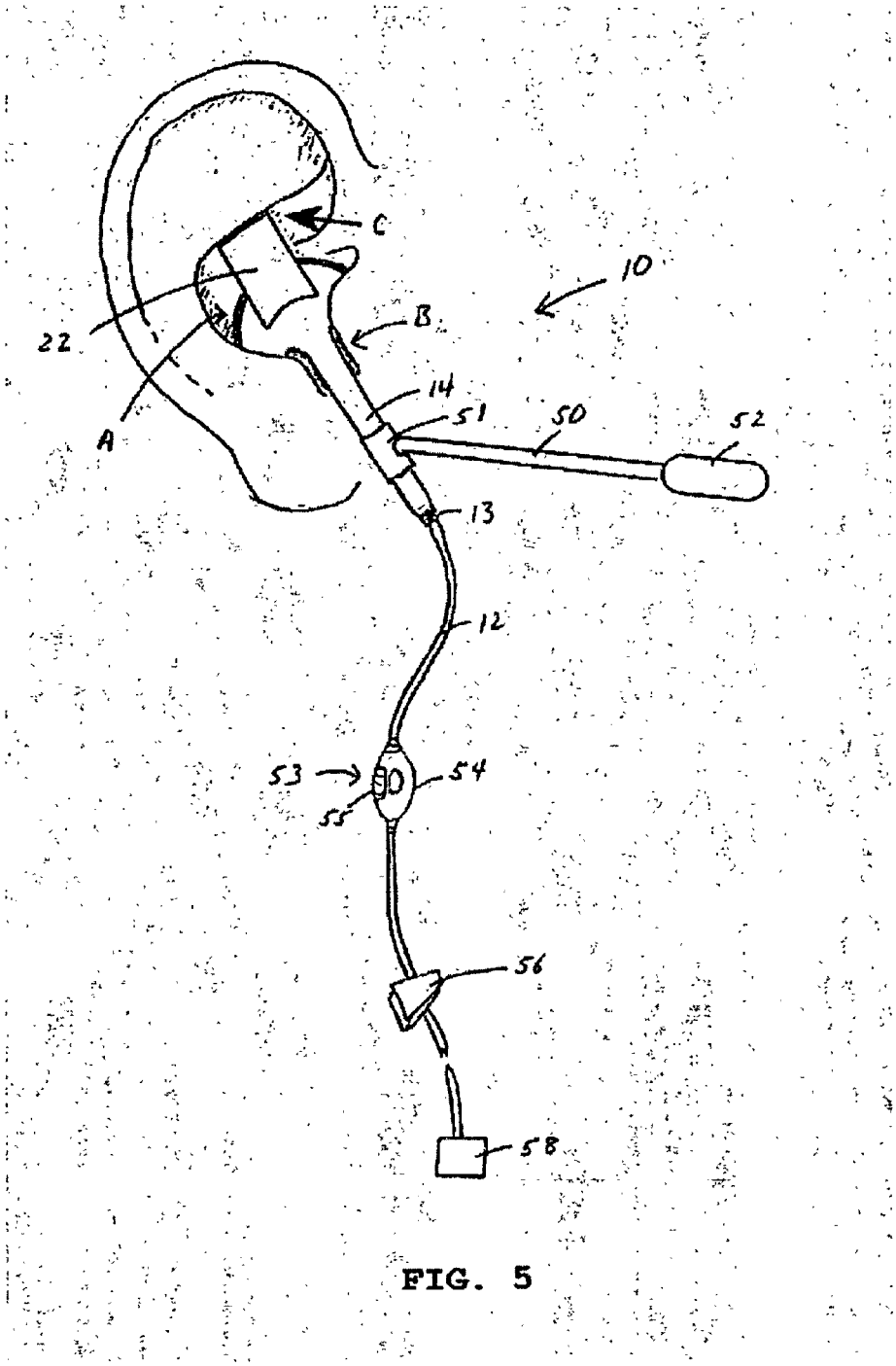
FIG. 5 illustrates an earbud headset including a microphone boom and a microphone pod, disposed in a user's ear, in accordance with an embodiment of the present invention.

FIG. 5 illustrates the positioning of earbud headset 10 mounted on a user's ear in accordance with an embodiment of the present invention.

When headset 10 is fully mounted on the ear, headset 10 may contact the user's ear in at least three areas to provide effective acoustic coupling with improved stability and comfort. Head portion 18 and thin edge portion 20 may first be placed in the lower concha area to form a first contact area "A". Advantageously, the thin edge portion allows for greater coupling in front of the ear canal, and since no accessories such as rings or cushions are required, sound may be more clearly transmitted to the ear canal, resulting in improved sound quality. As center portion 16 and tail portion 14 are simultaneously mounted on the ear with head portion 18 and thin edge portion 20, a second contact area "B" is formed between curved section 16 and/or tail portion 14 and the tragus and anti-tragus and/or intertragic notch of the user's ear. Finally, when bias member 22 is mounted on the ear, at least a third contact area "C" is formed between bias member 22 and a portion of the upper concha of the user's ear.

The multiple contact areas with the ear distribute weight and pressure such that headset 10 is more stable on the ear, and the required contact force against the concha area of the ear is reduced, which results in enhanced, long-term headset user comfort.

In headsets used for telephonic or similar type communications, a microphone may be positioned in the vicinity of the user's mouth, usually by a tubular extension, voice tube, boom, or in-line pod, for receiving the user's voice and transmitting it over a telecommunications line. Referring again to FIG. 5, earbud headset 10 may include a microphone 52 and/or a microphone 54 to enable two-way voice communication by the user in accordance with an embodiment of the present invention. In one embodiment, microphone 52 may be attached to a boom 50, which is operably connected to the speaker housing, in particular to tail portion 14 in one example. Optionally, a movable joint 51, such as a swinging mechanism, may couple boom 50 to speaker housing 19, such that boom 50 may swing back and forth to the user's mouth and lock into a position as desired by the user.

In another embodiment, microphone 54 is enclosed in a pod 53 below speaker housing 19 inline with cable 12. Microphone faceplate 55 provides a mesh opening on one side of pod 53 to allow the user to transmit voice signals as desired. Microphone pod 53 may further include volume control and/or a call switch by including a circuit board operably embedded into the pod and operably connected inline with cable 12 to allow for quick access to volume control and/or actuation of the answer/end call function.

Headset 10 may also include a clothing pin 56 for keeping microphone pod 53 close to the user's mouth and/or cable 12 close to the user's body.

Furthermore, a connector 58 operably connects the earbud headset to an audio source 11 (FIG. 2), such as a telephone handset, cellular telephone, a media device, or a computer, and a transmitter for sending voice signals from the user. In one example, with no intent to limit the invention thereby, connector 58 is a 2.5 mm plug or a suitable adapter that allows coupling to the audio source device.

Figure 6:
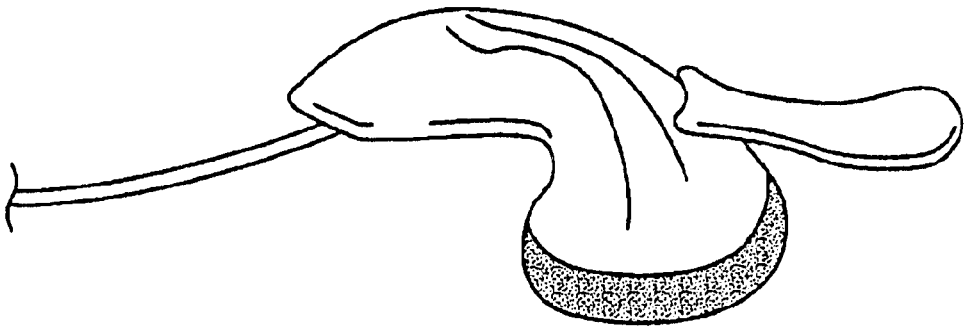
FIG. 6 is a perspective view of an earbud headset in accordance with an embodiment of the present invention.
Figure 7:
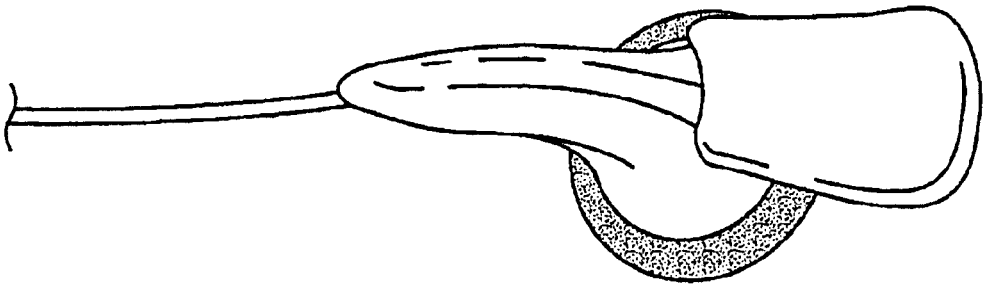
FIG. 7 is another perspective view of an earbud headset in accordance with an embodiment of the present invention.

FIGS. 6–7 show different perspective views of an enhanced earbud headset 10 in accordance with an embodiment of the present invention.

Figure 8:
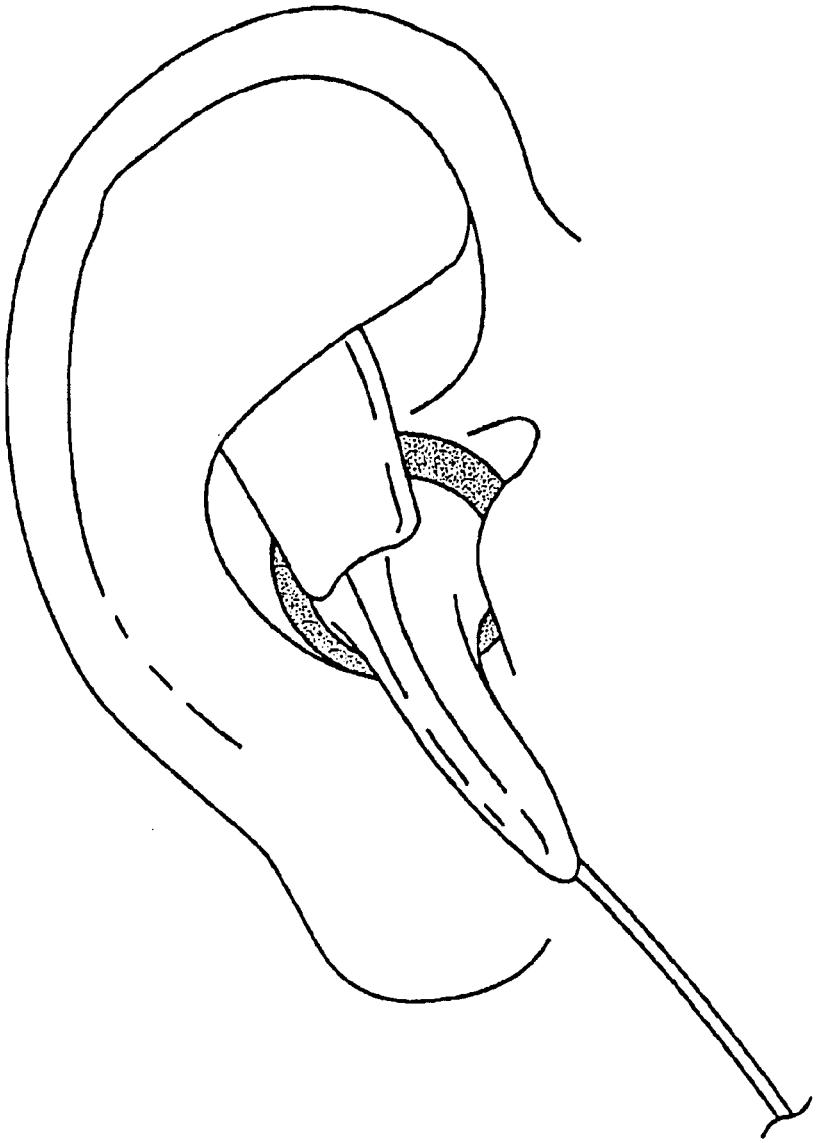
FIG. 8 illustrates an earbud headset disposed in a model ear in accordance with an embodiment of the present invention.

FIG. 8 shows an enhanced earbud headset 10 mounted in a model ear in accordance with an embodiment of the present invention.

The above-described embodiments of the present invention are merely meant to be illustrative and not limiting. Various changes and modifications may be made within the scope of this invention. Therefore, the appended claims encompass all such changes and modifications.

What is claimed is:

1. An earbud headset, comprising:

a speaker housing, including:

a head portion for contacting a lower concha of a ear, and a thin edge portion that extends from the head portion to interface with a faceplate; and a bias member operably coupled to the speaker housing, wherein the bias member is capable of contacting a portion of the upper concha of the ear, and further wherein the bias member provides bias forces toward the plane of the faceplate.

2. The headset of claim 1, wherein the head portion includes a transducer.

3. An earbud headset, comprising:

a speaker housing, including:

a head portion for contacting a lower concha of a ear, wherein the head portion includes a transducer, and a thin edge portion that extends from the head portion to interface with a faceplate; and a bias member operably coupled to the speaker housing, wherein the bias member is capable of contacting a portion of the upper concha of the ear, and further wherein the bias member provides bias forces on the speaker housing behind the transducer.

4. The headset of claim 1, wherein the diameter of the head portion increases toward the thin edge portion.

5. The headset of claim 1, wherein the thin edge portion has a thickness less than about 1 mm.

6. The headset of claim 1, wherein the speaker housing further comprises a center portion capable of contacting a tragus and an anti-tragus of the ear.

7. The headset of claim 6, wherein the center portion includes a concave surface.

8. The headset of claim 7, wherein the bias member is operably coupled to the speaker housing opposite the concave surface.

9. The headset of claim 6, wherein the bias member is operably coupled to the center portion.

10. The headset of claim 1, wherein the bias member is operably coupled to the head portion.

11. An earbud headset, comprising:

a speaker housing, including:

a head portion for contacting a lower concha of a ear, and a thin edge portion that extends from the head portion to interface with a faceplate; and a bias member operably coupled to the speaker housing, wherein the bias member is capable of contacting portion of the upper concha of the ear, and further wherein the bias member is operably coupled to the speaker housing apart from a plane of the thin edge portion.

12. The headset of claim 1, wherein the bias member is capable of contacting a portion of the upper concha of the ear in a different plane than the faceplate.

13. The headset of claim 1, wherein the bias member curves away from the thin edge portion.

14. The headset of claim 1, wherein the bias member is detachable from the speaker housing.

15. The headset of claim 1, further comprising a microphone operably coupled to the speaker housing.

16. The headset of claim 15, wherein the microphone is embedded in a pod along at least one wire coupling the transducer to an audio source.

17. The headset of claim 15, wherein the microphone is operably coupled to a boom which is operably coupled to the speaker housing.

18. An earbud headset, comprising:

a speaker housing, including:

a center portion including a concave surface, a head portion that extends from the center portion for contacting a lower concha of a ear, wherein the head portion includes a transducer, and a thin edge portion that extends from the head portion to interface with a faceplate; and a bias member operably coupled to the speaker housing, wherein the bias member is capable of contacting a portion of the upper concha of the ear, and further wherein the bias member is operably coupled to the speaker housing opposite the concave surface.

19. The headset of claim 18, wherein the thin edge portion has a thickness less than about 1 mm.

20. The headset of claim 18, wherein the bias member is coupled to the center portion.

21. The headset of claim 18, wherein the bias member is coupled to the head portion.

22. The headset of claim 18, wherein the bias member provides bias forces on the speaker housing behind the transducer.

23. The headset of claim 18, wherein the bias member provides bias forces toward the plane of the faceplate.

24. An earbud headset, comprising:

a speaker housing, including:

a tail portion for contacting an intertragic notch of the ear, a center portion that extends from the tail portion, wherein the center portion is capable of contacting a portion of a tragus and an anti-tragus of an ear, a head portion that extends from the center portion for contacting a lower concha of a ear, wherein the head portion includes a transducer, and a thin edge portion that extends from the head portion to interface with a faceplate; and a bias member operably coupled to the head portion, wherein the bias member is capable of contacting a portion of the upper concha of the ear, and further wherein the bias member provides bias forces toward the plane of the faceplate.

25. The headset of claim 24, wherein the tail portion tapers away from the center portion.

26. The headset of claim 24, wherein the thin edge portion has a thickness less than about 1 mm.

27. The headset of claim 24, wherein the bias member provides bias forces on the speaker housing behind the transducer.

* * * * *